United States Patent [19]

Englmeier et al.

[11] Patent Number: 4,998,094

[45] Date of Patent: Mar. 5, 1991

[54] SAFEGUARD DEVICE

[75] Inventors: Martin Englmeier, Lenting; Hans-Werner Weber, Ingolstadt; Thomas F. Enkelmann, Bremen; Salim Moolji, Achim-Baden, all of Fed. Rep. of Germany

[73] Assignee: Telefunken electronic GmbH, Heilbronn, Fed. Rep. of Germany

[21] Appl. No.: 333,695

[22] Filed: Apr. 5, 1989

[30] Foreign Application Priority Data

Apr. 9, 1988 [DE] Fed. Rep. of Germany ..... 3811912

[51] Int. Cl.[5] ..... G08B 13/14

[52] U.S. Cl. ..... 340/572; 340/521

[58] Field of Search ..... 340/572, 825.72, 517, 340/521-522, 508; 324/260, 243

[56] References Cited

U.S. PATENT DOCUMENTS

| | | | |
|---|---|---|---|
| 4,167,004 | 9/1979 | Schenck et al. | 340/517 X |
| 4,401,976 | 8/1983 | Stadelmayr | 340/522 |
| 4,471,344 | 9/1984 | Williams | 340/572 |
| 4,700,179 | 10/1987 | Fancher | 340/572 |

*Primary Examiner*—Glen R. Swann, III
*Assistant Examiner*—Thomas J. Mullen, Jr.
*Attorney, Agent, or Firm*—Spencer & Frank

[57] ABSTRACT

A safeguard device is provided with a high frequency sensor which triggers an alarm device after receiving high frequency energy. To prevent the alarm device being rendered ineffective by high frequency shielding of the safeguard device, a metal sensor is provided in addition which activates the alarm device regardless of the presence of high frequency energy when it is attempted to shield the safeguard device.

17 Claims, 2 Drawing Sheets

SAFEGUARD DEVICE

BACKGROUND OF THE INVENTION

The invention is concerned with a safeguard device having a selective high frequency sensor that triggers an alarm device after receiving high frequency energy.

Safeguard devices of this type containing a sensor reacting to a high frequency field are quite generally known. If this safeguard device comes within a high frequency field, an alarm device is triggered. Safeguard devices of this type are used in department stores to secure high-priced goods from theft. However, it is possible with safeguard devices of this type to prevent the alarm device being triggered by high-frequency-effective shielding. It is sufficient here to pack the safeguard device in aluminum foil or a metal-lined carrier bag or a metal container, for example.

SUMMARY OF THE INVENTION

The object of the invention is to provide a safeguard device of the above described type wherein the alarm device is triggered even when the safeguard device is high-frequency-shielded.

The object is attained in accordance with the invention by providing the housing for the high frequency sensor with a metal sensor which additionally activates the alarm.

In an embodiment of a safeguard device in accordance with the invention, a metal sensor determines whether the safeguard device is inside high-frequency-shielding metallic surroundings. If this is the case, the metal sensor generates a control signal that triggers the alarm device even outside the high frequency field, which is as a rule only generated at the exit of a sales area. The alarm device is fitted with a battery, rechargeable if necessary, so that the safeguard device can emit an alarm signal by itself. Although the alarm device of this type can also respond when other metallic objects are placed adjacently to it, for example in a shopping trolley, a safeguard device having these features is nevertheless a reliable safeguard for bulky articles, since articles of this type, for example fur coats, are usually worn by the thief. Furthermore, articles safeguarded in this way can also be provided with notices that they should be kept away from other metallic objects to prevent false alarms and so avoid discrimination of honest customers. In any case, any attempt to shield the safeguard device from high frequency triggers the alarm even before the article reaches the signal barrier arranged at the exit. This increases the length of the escape route and thereby also the chance of apprehending dishonest persons.

BRIEF DESCRIPTION OF THE DRAWINGS

The invention will now be described in greater detail, by way of examples, with reference to the drawings, in which.

DESCRIPTION OF THE PREFERRED EMBODIMENTS

In the figures, identical parts have been provided with the same reference symbol.

Figure 1:
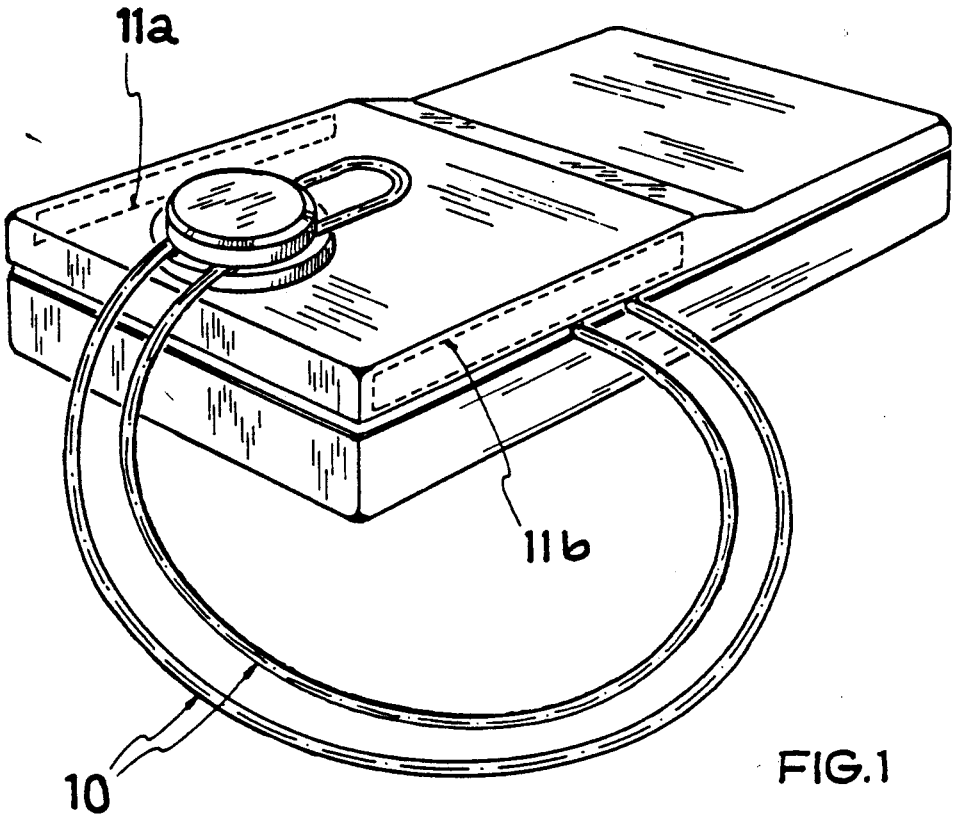
FIG. 1 is a perspective view of a housing of the safeguard device in accordance with the invention.

In the housing according to FIG. 1 containing the selective high-frequency sensor, two electrically conductive surfaces 11*a* and 11*b* are provided as a metal sensor, which trigger the alarm device when connected in electrically conductive manner, for example when the safeguard device is wrapped in aluminum foil. To increase security, further electrically conductive surfaces can be provided on the housing.

Figure 2:
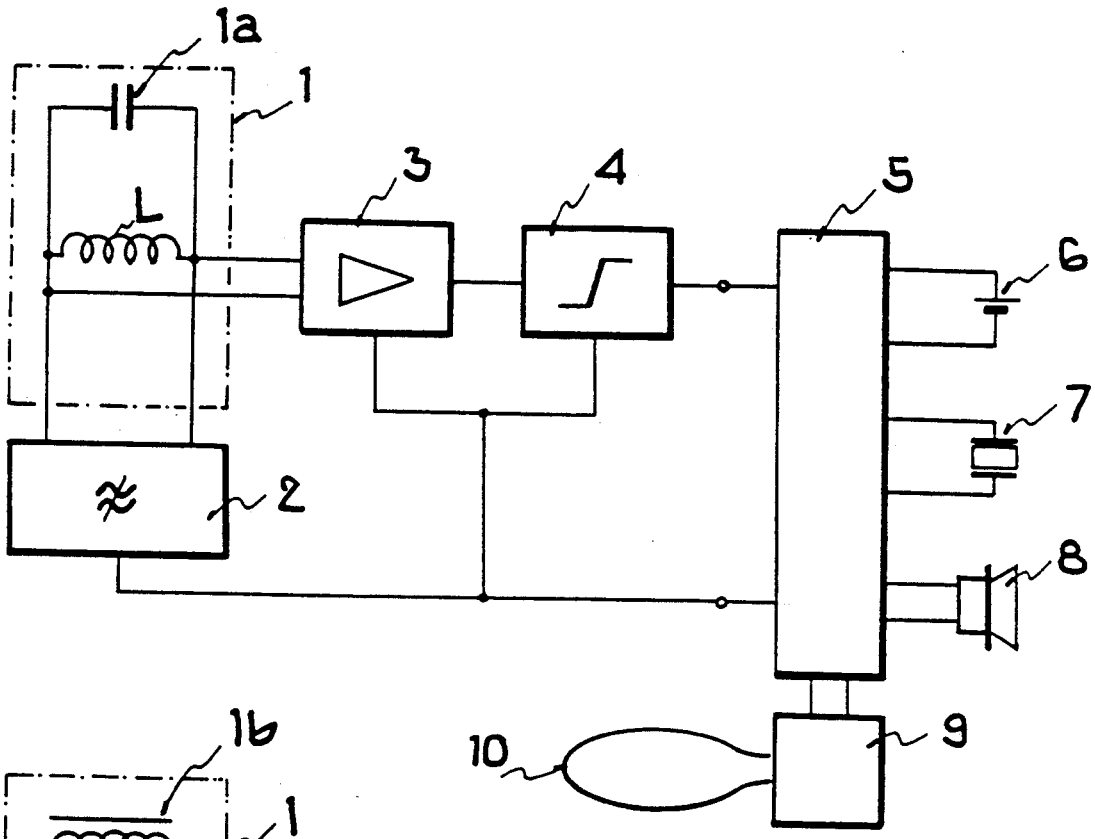
FIG. 2 is a block diagram of an embodiment of a high-frequency sensor of the safeguard device in accordance with the invention.

The two electrically conductive surfaces 11*a* and 11*b* can also form the coatings of an electrical capacitor when insulated electrically against external tampering, for example by metallization of the corresponding areas on the inside of the housing. If metal objects come into proximity with these electrically conductive surfaces, the capacitance of this capacitor changes considerably. The block diagram of a corresponding selective high-frequency sensor is shown in FIG. 2, in which this capacitor is identified with 1*a*. This capacitor 1*a* forms together with coil L a parallel resonant circuit fed by an AC voltage generator 2. This parallel resonant circuit 1 is connected to an amplifier 3 to whose output a threshold switch 4 is connected. Finally, the output of this threshold switch 4 and AC voltage generator 2 are connected to an evaluation circuit 5. This evaluation circuit 5 is supplied by an operating voltage source 6 and a quartz oscillator 7. Furthermore, this evaluation circuit 5 is connected to a piezo-electric loudspeaker 8 for emission of an alarm signal. In addition, a detector circuit 9 is connected to evaluation circuit 5 for reception of the high-frequency energy. This detector circuit 9 is connected to an antenna 10 which doubles as an electrically conductive securing element for securing the safeguard device attached to the object to be safeguarded.

The parallel resonant circuit 1 is fed by AC voltage generator 2 with the resonance frequency of the resonant circuit, with the actuation of AC voltage generator 2, amplifier 3 and threshold switch 4 being synchronized by evaluation circuit 5, thereby reducing the energy consumption. A high signal level is passed to amplifier 3 by parallel resonant circuit 1 tuned to its resonance frequency. The amplified signal is then compared in threshold switch 4 with a reference voltage. The result of this comparison is passed to evaluation circuit 5 for evaluation. If, however, parallel resonant circuit 1 is mistuned by the proximity of metal objects, a low signal level passes to amplifier 3. The amplified signal passing to threshold switch 4 leads to a change in its output level, thereby triggering an alarm via evaluation circuit 5. If the capacitive sensor is then introduced electrically insulated into electrically conductive foils, particularly metal ones, or into metal containers or tubes shielding the high frequency energy, then the presence of the high frequency shield is determined by this metal sensor and the alarm device is triggered.

The metal sensor can also however by designed as an inductive-action metal detector, for example as used to find metal piping in masonry or in conventional control technology. An embodiment of this type is shown in the block diagram of a high-frequency sensor according to FIG. 3, where a pickup coil 1*b* and a capacitor C form a series resonant circuit within the hatched line 1 instead of a parallel resonant circuit as shown in FIG. 2. In all other respects the circuit according to FIG. 3 is identical to that in FIG. 2.

Figure 3:
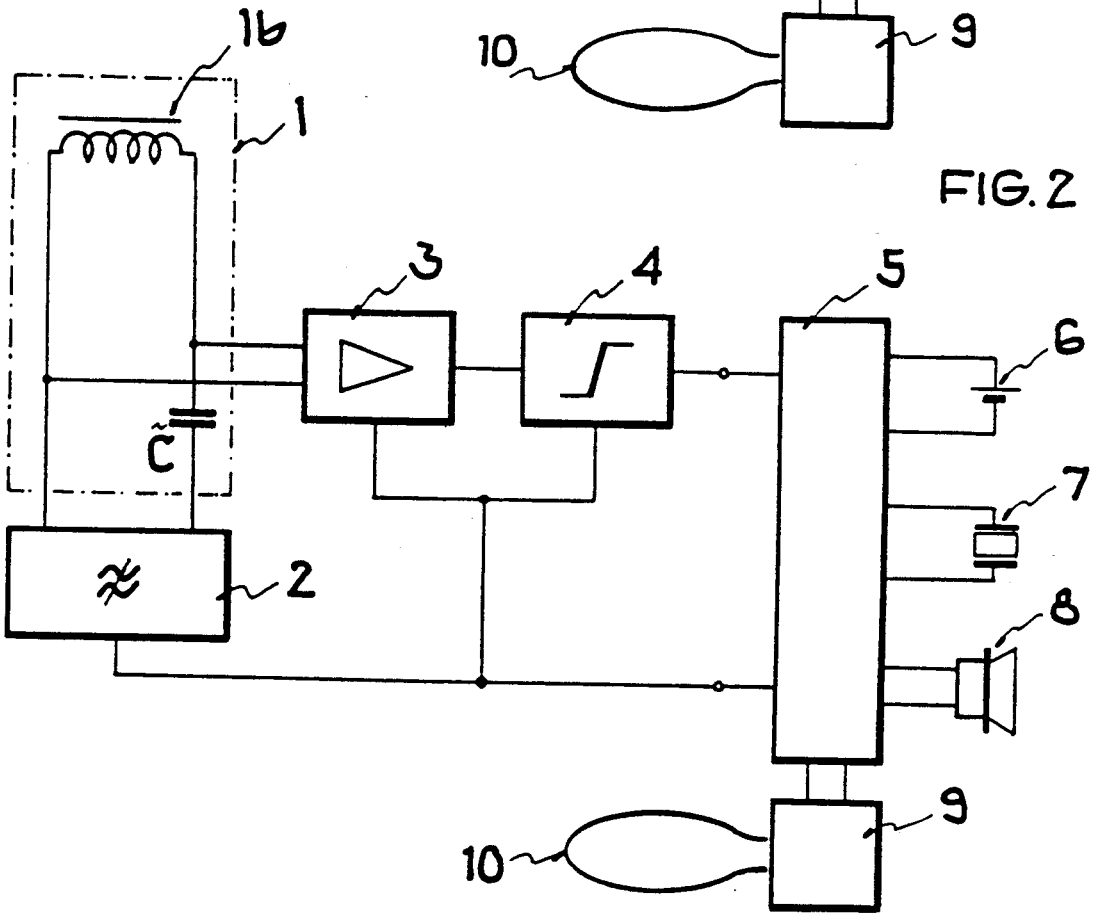
FIG. 3 is a block diagram of a further embodiment of a high-frequency sensor of the safeguard device in accordance with the invention.

In the circuit according to FIG. 3 too, series resonant circuit 1 is fed by AC voltage generator 2 with a high frequency corresponding to the resonance frequency of the resonant circuit. If metallic or other electrically conductive foils or objects come into proximity, the change in the inductance of pickup coil 1*b* containing a ferrite core causes mistuning of the resonant circuit, which is evaluated by amplifier 3, threshold switch 4 and evaluation circuit 5, and also leads to an alarm.

A further method of evaluation is to emit the high frequency fed into resonant circuit 1 via an antenna line, with an increased power output via this antenna line being evaluated upon the approach of a metallic or otherwise electrically conductive object and converted into a triggering signal for the alarm device.

Furthermore, it is also possible to provide a safeguard device with several types of metal sensor acting in different ways.

What is claimed is:

1. In a safeguard device having a housing including a selective high frequency sensor that triggers an alarm device after receiving high frequency energy, the improvement wherein said housing is provided with a metal sensor which additionally, and independently of said high frequency sensor, controls said alarm device.

2. A safeguard device according to claim 1, wherein said metal sensor has at least two electrically conductive surfaces arranged on the outside of said housing, which when connected in an electrically conductive manner trigger the alarm device.

3. A safeguard device according to claim 1, wherein said metal sensor has on the housing at least two surfaces which are insulated electrically against external tampering but which are in themselves electrically conductive and form the coatings of an electrical capacitor whose capacitance is changeable by the proximity of metal objects or metal foils and which is operatively connected internally to an evaluation circuit associated with the alarm device.

4. A safeguard device according to claim 1, wherein said metal sensor comprises an inductive metal detector which is arranged in said housing and whose inductance is changeable by the proximity of metal objects or metal foils, whereby the change in inductance triggers the alarm device.

5. A safeguard device according to claim 1 wherein said alarm device is within said housing.

6. A safeguard device comprising:

a housing; an alarm device disposed in said housing; selective high frequency sensor means disposed in said housing for triggering said alarm device after receiving high frequency energy; and a metal sensor means disposed in said housing for triggering said alarm device, independent of said high frequency sensor means, after detecting the presence of metal adjacent said housing, whereby an attempt to thwart the safeguard device by covering the housing with an electrically conductive high-frequency-effective shielding material, will be detected by said metal sensor means.

7. A safeguard device according to claim 6 wherein said metal sensor means comprises at least two conductive surfaces arranged on the outside of said housing which surfaces, when connected in an electrically conductive manner by metal, trigger said alarm device.

8. A safeguard device according to claim 6 wherein said metal sensor means comprises a tuned resonant circuit having a reactive component whose value is varied by the presence of metal.

9. A safeguard device according to claim 8 wherein said reactive component is an inductance.

10. A safeguard device according to claim 9 wherein said resonant circuit is a series resonant circuit.

11. A safeguard device according to claim 8 wherein said reactive component is a capacitor formed by two spaced conductive surfaces disposed on said housing.

12. A safeguard device according to claim 11 wherein said resonant circuit is a parallel resonant circuit.

13. A safeguard device for protecting objects from theft comprising:

a housing having means for releasably attaching said housing to an object to be protected;

an alarm device disposed in said housing;

first sensor means disposed in said housing for triggering said alarm device after receiving high frequency energy of a selected frequency; and a second sensor means disposed in said housing, and operating independently of said first sensor means, for detecting the presence, around said housing, of an undesired metal shield for said high frequency energy, and for triggering said alarm device in response to such detection, whereby an attempt to thwart the safeguard device by covering it with an electrically conductive high frequency effective shielding material will be detected.

14. A safeguard device as defined in claim 13, wherein said second sensor means comprises at least two electrically conductive surfaces arranged on the surface of said housing and electrically insulated from each other.

15. A safeguard device as defined in claim 14, wherein said surfaces are electrical contacts which trigger the alarm device when two or more of said contacts are connected in an electrically conductive manner.

16. A safeguard device as defined in claim 14, wherein said conductive surfaces form a capacitor whose capacitance is changeable by the proximity of metal and said second sensor means further comprises circuit means, disposed in said housing, for detecting a change in capacitance of said capacitor to trigger the alarm device.

17. A safeguard device as defined in claim 13, wherein said second sensor means is an inductive metal sensor comprising an inductor whose inductance is changeable by the proximity of metal, and circuit means operatively connected to said inductor for detecting a change in inductance of said inductor and for triggering said alarm device.

* * * * *